United States Patent [19]

Morita et al.

[11] Patent Number: 4,866,932

[45] Date of Patent: Sep. 19, 1989

[54] APPARATUS FOR TREATING PARTICULATE EMISSION FROM DIESEL ENGINE

[75] Inventors: Izuru Morita, Hachioji; Masayoshi Kajitani, Kanagawa; Masao Kodama, Ohme; Masanobu Takano, Tokyo, all of Japan

[73] Assignees: Shin Caterpillar Mitsubishi Ltd.; Nippon Donaldson Ltd., Tokyo, Japan

[21] Appl. No.: 217,419

[22] Filed: Jul. 8, 1988

[30] Foreign Application Priority Data

Nov. 9, 1987 [JP] Japan ..... 62-282393

[51] Int. Cl.[4] ..... F01N 3/02

[52] U.S. Cl. ..... 60/288; 55/466; 55/523; 55/DIG. 30; 60/299; 422/179; 422/180

[58] Field of Search ..... 60/288, 299; 55/466, 55/523, DIG. 30; 422/179, 180

[56] References Cited

U.S. PATENT DOCUMENTS

| | | | |
|---|---|---|---|
| 3,597,165 | 8/1971 | Keith | 60/299 |
| 3,695,851 | 10/1972 | Perga | 422/179 |
| 4,426,844 | 1/1984 | Nakano | 60/295 |
| 4,709,549 | 12/1987 | Lepperhoff | 60/311 |

FOREIGN PATENT DOCUMENTS

| | | |
|---|---|---|
| 31167 | 6/1980 | Japan . |
| 31165 | 9/1981 | Japan . |
| 49452 | 9/1981 | Japan . |
| 31166 | 1/1982 | Japan . |
| 49453 | 4/1982 | Japan . |
| 7251 | 7/1982 | Japan . |
| 105915 | 6/1984 | Japan . |
| 175718 | 9/1985 | Japan . |

*Primary Examiner*—Douglas Hart

*Attorney, Agent, or Firm*—Robert E. Burns; Emmanuel J. Lobato

[57] ABSTRACT

An apparatus which is disposed in an exhaust system of a diesel engine for treating particulate emissions contained in exhaust gas is disclosed. The apparatus comprises a splittable casing body including an inlet-side casing portion and an outlet-side casing portion, an inlet pipe secured to the inlet-side casing portion, an outlet pipe secured to the outlet-side casing portion, a partition plate detachably retained between the inlet- and outlet-side casing portions such as to divide the inside of the casing body into two compartments, and at least one filter assembly detachably mounted in an opening provided in the partition plate. The filter assembly is defined by a honeycomb-type ceramic filter which is accommodated in a metallic casing and surrounding by a cushioning material, and which has a catalyst carried on its internal passage wall. The catalyst enables a lowering in the combustion temperature of the particulate emissions. The ceramic filter is detachable from the partition plate together with the metallic casing in one unit. Accordingly, it is possible to replace the filter with ease and to vary appropriately the number of filters in accordance with the displacement volume of the engine concerned.

5 Claims, 4 Drawing Sheets

APPARATUS FOR TREATING PARTICULATE EMISSION FROM DIESEL ENGINE

BACKGROUND OF THE INVENTION

1. Field of the Invention

The present invention relates to a particulate emission treating apparatus designed to filter and burn particulate emissions (mainly black smoke particles) contained in exhaust gas from a diesel engine used in a construction machine or the like. More particularly, the present invention pertains to a particulate emission treating apparatus which is disposed in the exhaust system of a diesel engine and which employs a honeycomb type ceramic filter to filter and burn particulate emissions.

2. Description of the Related Art

One type of particulate emission treating apparatus has heretofore been known which employs a honeycomb type ceramic filter to filter and burn particulate emissions from a diesel engine used in a construction machine or the like. Such a honeycomb type ceramic filter is disclosed in, for example, "Diesel Particulate Control" in Automotive Engineering, November 1984, pages 63–70, published by the Society of Automotive Engineers Inc. in 1984 and "Diesel motorcar Exhaust Gas and countermeasures therefor" in Machine Research, Vol. 39, No. 10, pages 1103–1104, published by Japan Machinery Institute in 1987. FIG. 1 illustrates a prior art particulate emission treating apparatus incorporating a honeycomb type ceramic filter of the type described above, in which a ceramic filter 5 is accommodated in a casing 3 disposed between exhaust system pipe lines 1*a* and 1*b* and surrounded by a cushioning material 7. With this structure, however, the cushioning material 7 thermally expands in the area between the filter 5 and the casing 3 during use, and this makes it difficult to remove the filter 5. When seeking to replace the filter 5, therefore, it is necessary to conduct a troublesome operation in which the filter 5 is removed from the casing 3 by crushing it while pulling it up and then a new filter is fitted surrounded by the cushioning material 7. To overcome this problem, another prior art such as that shown in FIG. 2 has been proposed in which a ceramic filter 5 is accommodated in an integrally formed casing 3*a* with a cushioning material 7 surrounding it, the ceramic filter 5 being replaceable together with the casing 3*a* in one unit, which is disposed between exhaust system pipe lines 1*c* and 1*d*, without the need to remove the ceramic filter 5 from the casing 3*a*. This structure cannot, however, be adapted to an arrangement in which a plurality of filters need to be provided, and it is also impossible to form a large ceramic filter because of structural limitations due to the strength of the ceramics. Hence, this type of apparatus cannot be used for an engine having a large displacement volume.

SUMMARY OF THE INVENTION

In view of the above-described circumstances, it is a primary object of the present invention to provide an apparatus for treating particulate emissions from a diesel engine which is free from the above-described disadvantages of the prior art.

To this end, the present invention provides an apparatus which is disposed in an exhaust system of a diesel engine to treat particulate emissions contained in exhaust gas, the apparatus comprising: a splittable casing body including an inlet-side casing portion and an outlet-side casing portion; an inlet pipe secured to the inlet-side casing portion; an outlet pipe secured to the outlet-side casing portion; a partition plate detachably retained between the inlet- and outlet-side casing portions to divide the inside of the casing body into two compartments; and at least one filter assembly detachably mounted in an opening provided in the partition plate, the filter assembly being defined by a honeycomb type ceramic filter which is accommodated in a metallic casing and surrounded by a cushioning material and which has a catalyst carried on its internal passage walls, the catalyst enabling a lowering in the combustion temperature of the particulate emissions, and the ceramic filter being detachable from the partition plate together with the metallic casing in one unit.

Several filter assemblies, the number of which is determined in accordance with the displacement volume of the engine, are mounted on the partition plate and this partition plate is secured within the casing. The treating apparatus thus formed is disposed in the exhaust system of the engine. During an operation of the engine, particulate emissions which are filtered by the ceramic filter are burned by means of exhaust gas. It is often the case that the exhaust gas temperature exceeds 500° C. in actual operations of construction machinery. Therefore, the particulate emissions (mainly black smoke particles) trapped in the treating apparatus can be satisfactorily burned under the catalytic action. Accordingly, there is no need to provide an additional heater, for example, a burner or an electric heater. However, it is effective practice to combine the apparatus with means for raising the exhaust gas temperature, such as throttling of a butterfly valve, to regenerate the filter according to need, for example, when a low-load running state has continued for a long time. When the ceramic filters need to be replaced because of plugging or breakage after long-term use, the treating apparatus is first removed from the exhaust system. Then, the splittable casing is separated into halves, and the filter assemblies secured to the partition plate are replaced with new ones. At this time, each ceramic filter can be replaced together with the metallic casing in one unit, and therefore the replacement is suitably facilitated. Also, since the partition plate which is provided with an appropriately determined number of filter assemblies may be mounted in the casing, it is possible to readily obtain a particulate emission treating apparatus which conforms with the displacement volume of the engine concerned. Further, since it is unnecessary to provide an additional combustor and it is possible to regenerate the filter without the need to remove it from the exhaust system, regeneration is facilitated.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements and, in which.

DESCRIPTION OF THE PREFERRED EMBODIMENT

One preferred embodiment of the present invention will be described hereinunder in detail with reference to the accompanying drawings.

Figure 1:
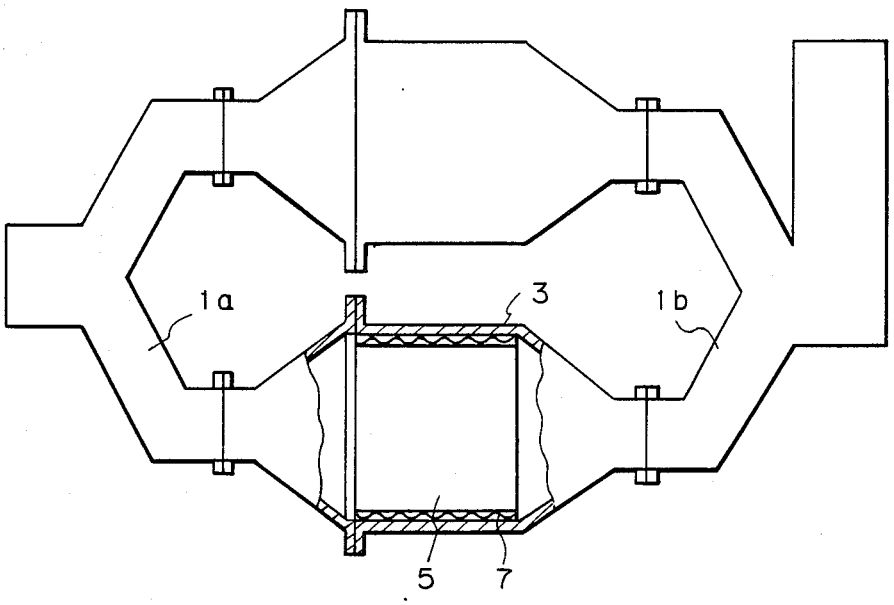
Fig. 1 PRIOR ART
FIGS. 1 and 2 are partly-sectioned side views respectively showing prior art particulate emission treating apparatus.
Figure 2:
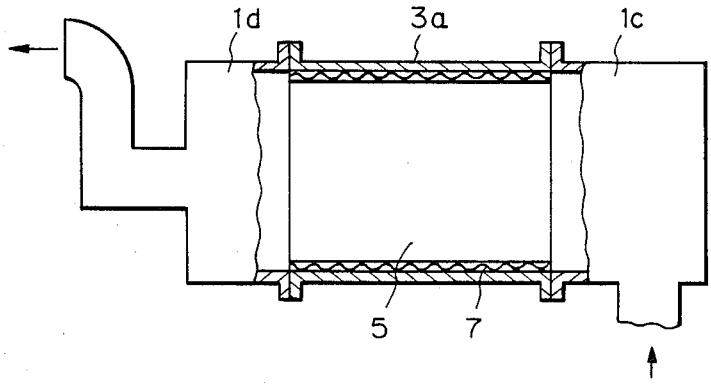
Fig. 2 PRIOR ART
Figure 3:
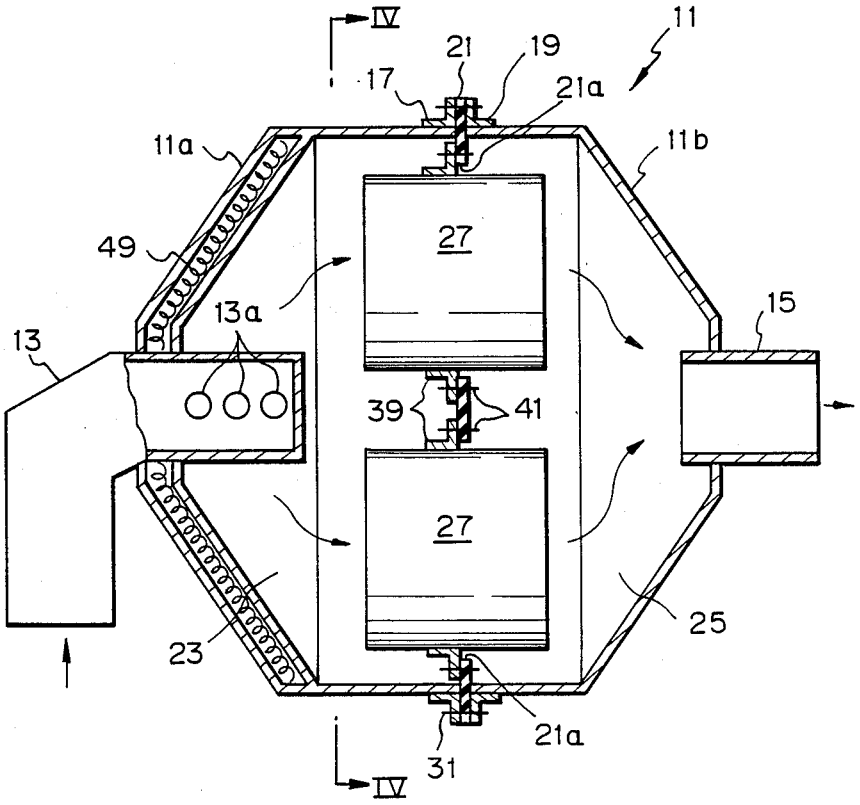
FIG. 3 is a sectional view of one embodiment of the particulate emission treating apparatus according to the present invention.
Figure 4:
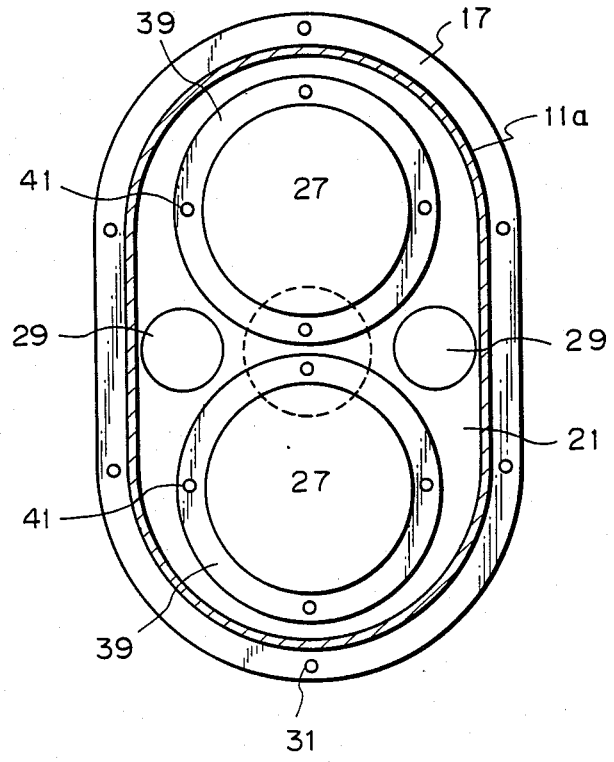
FIG. 4 is a sectional view taken along the line IV—IV of FIG. 3.

Referring first to FIGS. 3 and 4, which are sectional views of one embodiment of the present invention, the reference numeral 11 denotes a splittable casing comprising two halves, that is, an inlet-side casing portion 11*a* and an outlet-side casing portion 11*b*. An inlet pipe 13 is secured to the inlet-side casing portion 11*a* in such a manner that the end portion of the pipe 13 extends into the inside of the inlet-side casing portion 11*a*. An outlet pipe 15 is secured to the outlet-side casing portion 11*b* such that the end portion of the pipe 15 extends into the inside of the outlet-side casing portion 11*b*. Ring-shaped flanges 17 and 19 are respectively provided around the butted ends of the two casing portions 11*a* and 11*b*. The reference numeral 21 denotes a partition plate which is detachably clamped between the two flanges 17 and 19 so as to divide the inside of the casing 11 into two compartments 23 and 25. The numeral 27 denotes filter assemblies (two in the illustrated example) which are detachably mounted in respective openings 21*a* provided in the partition plate 21. The numeral 29 denotes by-pass valves (two in the illustrated example) which are respectively disposed at positions on the partition plate 21 other than those where the filter assemblies 27 are mounted.

Figure 5:
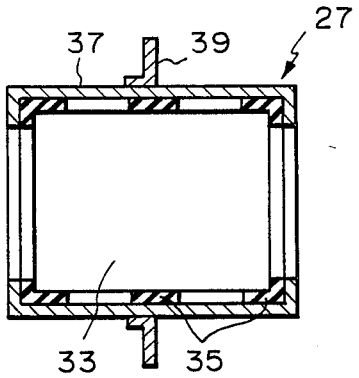
FIG. 5 is a sectional view of one filter assembly.

The partition plate 21 is clamped at its peripheral portion between the flanges 17 and 19 and the plate and flanges are fastened together at an appropriate number of positions by means, for example, of nuts and bolts, as shown by the reference numeral 31, thereby enabling the partition plate 21 to be secured to the casing 11 at the same time that the two casing portions 11*a* and 11*b* are joined together. Each filter assembly 27 which is mounted in the opening 21*a* provided in the partition plate 21 is, as shown in FIG. 5, arranged such that a ceramic filter 33 is covered at its periphery by a metallic casing 37 with a cushioning member 35 such as a thermal expansion seal or a wire mesh therebetween, and a doughnut-shaped flange 39 is rigidly secured around the central portion of the metallic casing 37. The filter assembly 27 is detachably secured to the partition plate 21 by fastening the flange 39 to the peripheral edge of the opening 21*a* in the partition plate 21 by means, for example, of nuts and bolts 41. The number of filter assemblies 27 ma be appropriately changed in accordance with the displacement volume of the engine for which the treating apparatus is used, and the number of openings 21*a* in the partition plate 21 may be changed correspondingly (two in the illustrated example).

Figure 6:
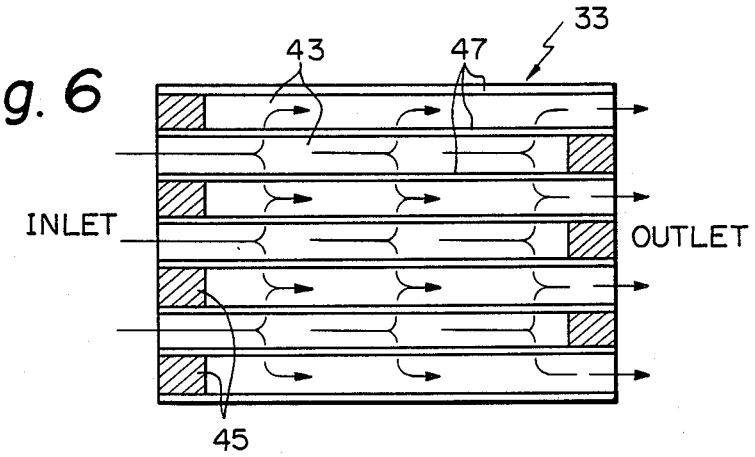
FIGS. 6 and 7 are sectional and end views, respectively, of the ceramic filter.
Figure 7:
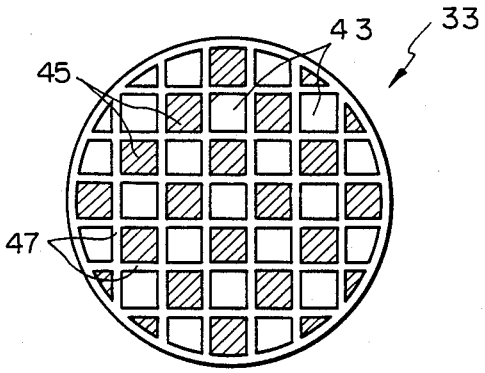

The ceramic filter 33 is, as shown in FIGS. 6 and 7, defined by a so-called honeycomb-type filter which has a substantially cylindrical shape as a whole and in which both the inlet and the outlet are filled with plugs 45 which are alternately disposed so that honeycomb passages 43 are defined inside the cylindrical filter. Exhaust gas passes through thin porous walls 47, as shown by the arrows in FIG. 6, so that particulate emissions contained in the exhaust gas are trapped in the thin porous walls 47. A catalyst which enables a lowering in the combustion temperature of particulate emissions are carried on the thin porous walls 47, so that the particulate emissions are burned within the ceramic filter 33 by means of the exhaust gas from the engine. It is preferable to employ a catalyst which is effective not only in lowering the combustion temperature of particulate emissions (mainly black smoke particles) but also in suppressing sulfate production and oxidizing harmful components such as HC and CO. Such a catalyst may be carried, for example, by alumina coated on the porous thin walls 47.

As shown in FIG. 3, the inlet-side casing portion 11*a* has a double-wall structure in which a heat insulating material 49 is placed in the space defined by two walls, thereby maintaining the exhaust gas immediately before the filter at a high temperature and thus enabling a high regeneration efficiency (i.e., with respect to combustion of the filtered particulate emissions) to be maintained. Maintaining the exhaust gas at a high temperature is particularly critical in a system where no additional heater such as a burner is used. In addition, since the filter assemblies 27 are retained by the partition plate 21 within high-temperature exhaust gas while being spaced apart from the casing portions 11*a* and 11*b* which are in contact with the outside cool air, it is possible to increase the regeneration efficiency.

As shown in FIG. 3, the inlet pipe 13 has its closed end portion extending into the inside of the inlet-side compartment 23, the end portion having a plurality of bores 13*a* dispersed around its periphery, which uniformly disperse exhaust gas to the filter assemblies 27. The dispersion of exhaust gas is particularly important in the case of an engine having a large displacement volume since in such a case a plurality of relatively small-sized filters must be mounted because of the structural limitations in regard to ceramic filters and therefore exhaust gas must be uniformly distributed in order to regenerate the filters uniformly.

The by-pass valves 29 are adapted to provide communication between the inlet- and outlet-side compartments 23 and 25 which by-passes the filters 27 when plugged and no regeneration can be effected even if the critical exhaust pressure is exceeded. The by-pass valves 29 ma be butterfly valves or ball valves which are opened and closed either manually or automatically.

It should be noted that plate-shaped gaskets are, although not shown, respectively provided at the area of contact between the partition plate 21 and each of the flanges 17, 19 of the casing portions 11*a*, 11*b*, and at the area of contact between the flange 39 of each filter assembly 27 and the periphery of the opening 21*a*, thereby maintaining the high sealing properties subsisting at the portions other than the filter portions.

The treating apparatus having the above-described arrangement is disposed in the exhaust system of a diesel engine so that particulate emissions which are filtered by the ceramic filters 33 are burned by means of exhaust gas. It is often the case that the exhaust gas temperature exceeds 500° C. in actual operations of construction machinery. Therefore, the particulate emissions (mainly black smoke particles) trapped in the treating apparatus can be satisfactorily burned under the catalytic action. When the ceramic filters need to be replaced because of plugging or breakage after long-term use, the treating apparatus is first removed from the exhaust system. Then, the splittable casing 11 is separated into halves, and the filter assemblies 27 secured to the partition plate 21 are replaced with new ones. At this time, each ceramic filter can be replaced together with the metallic casing in one unit, and therefore the replacement is significantly facilitated.

As has been described above, it is possible according to the present invention to replace filters with relative ease and to vary appropriately the number of filters in accordance with the displacement volume of the engine concerned. Thus, it is possible to obtain a particulate emission treating apparatus which is applicable to both a small- and large-sized diesel engines. Further, a catalyst which enables a lowering in the combustion temperature of particulate emissions is carried on the honeycomb passage walls of each filter and it is therefore possible to regenerate the filters by means of exhaust gas without the need to remove them from the exhaust system. Accordingly, there is no need to provide an additional combustor, the structure of the apparatus and the regeneration operation thus being simplified.

Although the present invention has been described through specific terms, it should be noted here that the described embodiment is not necessarily exclusive and that various changes and modifications may be imparted thereto without departing from the scope of the invention which is limited solely by the appended claims.

What is claimed is:

1. An apparatus which is disposed in an exhaust system of a diesel engine to treat particulate emissions contained in exhaust gas, said apparatus comprising:

a splittable casing body including an inlet-side casing portion and an outlet-side casing portion;

an inlet pipe secured to said inlet-side casing portion;

an outlet pipe secured to said outlet-side casing portion;

a partition plate detachably retained between said inlet-and outlet-side casing portions to divide the inside of said casing body into two compartments; and at least one filter assembly detachably mounted in an opening provided in said partition plate, said filter assembly being defined by a honeycomb-type ceramic filter which is accommodated in a metallic casing and surrounded by a cushioning material and which has a catalyst carried on its internal passage wall, said catalyst enabling a lowering in the combustion temperature of the particulate emissions, said ceramic filter being detachable from said partition plate together with said metallic casing in one unit;

said partition plate being provided with at least one by-pass valve which is opened and closed by at least one of manual and automatic actuation.

2. Apparatus which is disposed in an exhaust system of a diesel engine to treat particulate emissions contained in exhaust gas, said apparatus comprising:

splittable casing body including an inlet-side casing portion and an outlet-side casing portion, an inlet pipe secured to said inlet-side casing portion, an outlet pipe secured to said outlet-side casing portion, a partition plate detachably retained between said inlet-and outlet-side casing portions to divide the inside of said casing body into an inlet compartment and an outlet compartment, said partition plate having at least one opening therein between said inlet compartment and said outlet compartment, at least one filter assembly detachably mounted in said opening in said partition plate, said filter assembly comprising a cylindrical metallic casing of a size to be received in said opening in said partition plate and a honeycomb-type ceramic filter which is accommodated in said metallic casing and surrounded by cushioning material and which has a catalyst carried on its internal passage wall, said catalyst enabling a lowering in the combustion temperature of the particulate emissions, and means for releasably retaining said metallic casing in said opening of said partition plate, said filter assembly comprising said metallic casing and said ceramic filter therein being removable from said partition plate as a unit.

3. The apparatus of claim 2, wherein a part or the whole of said inlet-side casing portion has a double-wall structure having a heat insulating material disposed in the space defined by the two walls thereof.

4. The apparatus of claim 2, wherein a plurality of said filter assemblies are provided on said partition plate, said inlet pipe being defined by a cylindrical pipe having a closed end portion which extends into the inlet-side compartment and which has a plurality of bores provided in its peripheral surface.

5. The apparatus of claim 2, wherein said means for releasably retaining said metallic casing in said opening of said partition plate comprises a flange on said metallic casing and means for releasably securing said flange to said partition plate.

* * * * *